US006283340B1

(12) United States Patent
Waldner

(10) Patent No.: US 6,283,340 B1
(45) Date of Patent: Sep. 4, 2001

(54) TELESCOPIC NOZZLE FOR AN AIR GUN WITH SAFE PRESSURE RELEASE

(76) Inventor: Kurt Waldner, 329 Hampton St., Salinas, CA (US) 93906

( * ) Notice: Subject to any disclaimer, the term of this patent is extended or adjusted under 35 U.S.C. 154(b) by 0 days.

(21) Appl. No.: 09/442,050

(22) Filed: Nov. 16, 1999

(51) Int. Cl.[7] ..... B67D 5/06
(52) U.S. Cl. ..... 222/530; 222/538
(58) Field of Search ..... 222/530, 538; 239/532, 203, 204; 15/300.1, 318, 405, 410, 414, 415.1, 422.1

(56) References Cited

U.S. PATENT DOCUMENTS

| | | | | |
|---|---|---|---|---|
| 3,938,218 | * | 2/1976 | DeAmicis | 15/414 |
| 4,817,832 | | 4/1989 | Nagy | 222/530 |
| 4,886,212 | * | 12/1989 | Proctor et al. | 239/203 |
| 5,054,160 | * | 10/1991 | Marino | 15/414 |
| 5,540,359 | * | 7/1996 | Gobbel | 222/530 |
| 5,566,858 | * | 10/1996 | Ducker, III | 222/79 |
| 5,595,461 | | 1/1997 | Miller | 406/152 |
| 5,944,911 | * | 8/1999 | Winters et al. | 15/405 |
| 5,966,847 | * | 10/1999 | Nathenson et al. | 37/347 |

* cited by examiner

*Primary Examiner*—Kevin Shaver
*Assistant Examiner*—David Deal
(74) *Attorney, Agent, or Firm*—Robert Samuel Smith

(57) ABSTRACT

A telescopic extendable nozzle attachable to a pressurized source of gas. The nozzle permits blowing out otherwise inaccessible crannies with the nozzle extended or providing a blast of air over a wide area as required. An anchor section of the nozzle has an exit end connect connected to the entrance end of the telescoping section and an entrance end of the anchor section is connected to the exit end of the source. The anchor section has a passageway escape for gas that prevents sudden build up of pressure when the exit end of the nozzle is inadvertently obstructed. In one embodiment, the anchor section comprises an outer sleeve slidably mounted on an inner sleeve, both sleeves having apertures providing an adjustable passageway. A plug is positioned inside the inner sleeve and has a central bore for passing gas through the nozzle and a plurality of planet bores that provide relief from excessive pressure such as when the nozzle is inadvertently and suddenly stopped up.

13 Claims, 2 Drawing Sheets

TELESCOPIC NOZZLE FOR AN AIR GUN WITH SAFE PRESSURE RELEASE

FIELD OF THE INVENTION

This invention relates to nozzles for air hoses and particularly to a nozzle that has an adjustable telescoping end.

PRIOR ART AND INFORMATION DISCLOSURE

Air hoses discharging compressed air are used in many applications where a jet stream of air is the most effective way of blowing dust from a surface, drying, and particularly for dislodging debris lodged in cracks and crannies.

A typical "shop air hose" according to prior art includes a gun housing a conduit with an inlet port having a female thread on one end that is screwable onto a hose carrying forced air. An outlet port with a female thread is on the other end A button loaded by a spring on the central section of the body is depressed to open an internal valve permitting a blast of air to pass into the entry port, through the conduit and out of the exit port. An exit tube (shown detached) is screwed into the outlet port whose length depends on the circumstance of use.

In one circumstance, where it is desired to provide an air stream covering a wide area, the exit tube is very short. In another circumstance, where it is required to deliver a liquid (water) spray, the tube has a medium length(e.g., four inches and a side tube has one end connected perpendicularly to near the end of the exit tube and another end connected to a hose that dips into a container or source of the liquid so that the stream of air siphons the liquid out of the container.

In another application, where it is desired to direct a narrow air stream into otherwise inaccessible regions, the air stream is most effectively directed by attaching a long tube onto the outlet port.

In some work places, a combination of circumstances occur that require exchanges of tube having various lengths. In this case, it is necessary to have available a number of tubes and the user must suffer the inconvenience of having to frequently detach (unscrew) one tube from the body and attach a tube having a different length.

Various nozzle constructions for special applications have been disclosed in the prior art.

For example, U.S. Pat. No. 4,817,832 to Nagy discloses a nozzle assembly adapted for being secured on a container which comprises a helically formed member having one end secured to the container and another end extendable from the container by stretching the helix. This is not a practical construction for:"blowing out" debris from the cracks and crannies in accordance with the objects of the invention.

U.S. Pat. No. 5,595,461 to Miller discloses a density controller for conveying an air stream carrying particles wherein the nozzle is fitted onto a vacuum generator. This construction is not conveniently constructed for the purposes of this invention.

U.S. Pat. No. 5,706,983 discloses a trigger sprayer having a nozzle cover that telescopes onto the discharge orifice.

None of.

SUMMARY OF THE INVENTION

It is an object of this invention to provide an air gun with a nozzle that is useful in all circumstances requiring adjusting the length of the nozzle to a length that is adaptable to any one of various circumstances.

It is another object that the length-adjustable nozzle of this invention be constructed to prevent sudden inadvertent extension of the nozzle that might occur if the open end of the nozzle is suddenly (and accidentally) stopped up causing air pressure to increase inside the nozzle. Such accidental and sudden lengthening of the nozzle may cause damage and or injury to the user especially if he is "blowing off moving machinery such as an engine lathe.

This invention is directed toward an air gun having a telescoping nozzle of two or more sections. The overall length of the nozzle is variable by slidably positioning each section axially with respect to one another. The first section (opposite the open end of the nozzle) is secured to an "anchor" section that is secured to and communicates with the gun housing.

In one embodiment, the anchor section comprises an outer sleeve telescoped over an inner sleeve.

The inner sleeve encloses a cylindrical plug having a central bore extending from an entry opening to an exit opening through which air passes in normal use. Additionally there are one or more "planet" bores, parallel to the central bore extending from the exit end of the plug to a cavity between the plug and inner surface of the inner sleeve. The cavity is formed by a section of the plug between ends of the plug having a reduced diameter. Each sleeve has an aperture and when the apertures are aligned, excess pressurized air can pass back from the exit end of the plug, through the planet bores, into the cavity then out through the passageway formed by the apertures in the inner and outer sleeves. The outer sleeve can be positioned so as to vary the degree of misalignment of the sleeves and thereby vary the size of the passageway through the sleeve walls formed by the two apertures. When the apertures are aligned with one another and if the open end of the nozzle is inadvertently and suddenly closed, then the air otherwise passing through the nozzle passes out through the passageway so that air pressure in the nozzle does not increase and the nozzle does not suddenly lengthen.

In the construction just described, there will always be leakage of air from inside the inner sleeve through the unless the apertures are completely misaligned so that there is no opening from inside the sleeves to outside the sleeves. It is an embodiment of this invention that the rate of leakage and the force of air through the nozzle can be adjusted by adjusting the size of the passage. This is done by positioning the outside sleeve to establish a required passage size.

Two constructions are contemplated for adjusting the passageway size.

In one construction, the outer sleeve is axially positionable on the inner sleeve and in retracted position of the outer sleeve, the passageway is completely closed so that there is no air leakage through the passageway. When the open end of the nozzle is closed, the air pressure in the nozzle builds to a critical pressure above which the outer sleeve slides axially to a second position where the passage is open. The air escapes through the passage before the nozzle is able to extend. Critical pressure is selected by a collar having an adjustable diameter slipped over the outer sleeve. The tightness of the collar is adjusted to where resistance to sliding of the outer sleeve over the inner sleeve equals the force exerted by the critical pressure selected to extend the nozzle.

In a second construction, the outer sleeve is rotationally positionable on the inner sleeve. Degree of alignment of the apertures (size of the passageway is selected by appropriate rotation of the outer sleeve on the inner sleeve.

In yet another embodiment, the outer sleeve is positioned inside a porous tube such as fabric. The air escaping through the passageway is diffused in passing through tube thereby avoiding any problems accruing from a directed escaping stream of air that would otherwise occur without the tube.

DESCRIPTION OF PREFERRED EMBODIMENTS

Figure 1:
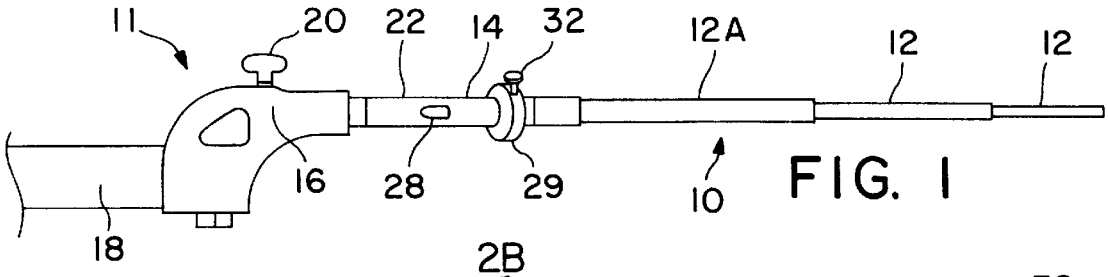
FIG. 1 shows one embodiment of the invention showing the anchor section.

Turning now to a discussion of the drawings, FIG. 1 shows an air gun 11 with the telescoping nozzle 10 of this invention including a plurality of tube sections 12, each tube section 12 slidably telescoping with a neighboring section beginning with a first end section 12A. The exit end of one tube slips into the entrance end of the neighboring tube. On each section, the exit end has an inner shoulder and the entrance end has an outer shoulder that prevents the nozzle from coming apart when the nozzle is fully extended (shoulders are not shown).

An "anchor" section 14 is connected on an "entrance" end to the gun housing 16 coupled to the air hose 18 and which also has the valve 20 for releasing air through the nozzle 10. The "exit" end of the gun 11 is connected to the first section 14 of the nozzle, anchor section 22.

Figure 2A:
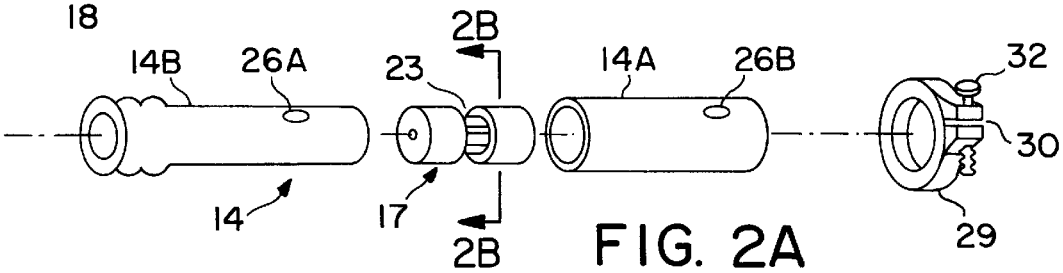
FIG. 2A is an exploded view of the anchor section.
Figure 2B:
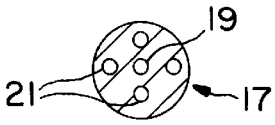
FIG. 2B is a sectional view of the plug shown in FIG. 2B taken along line of sight 2A.
Figure 2C:
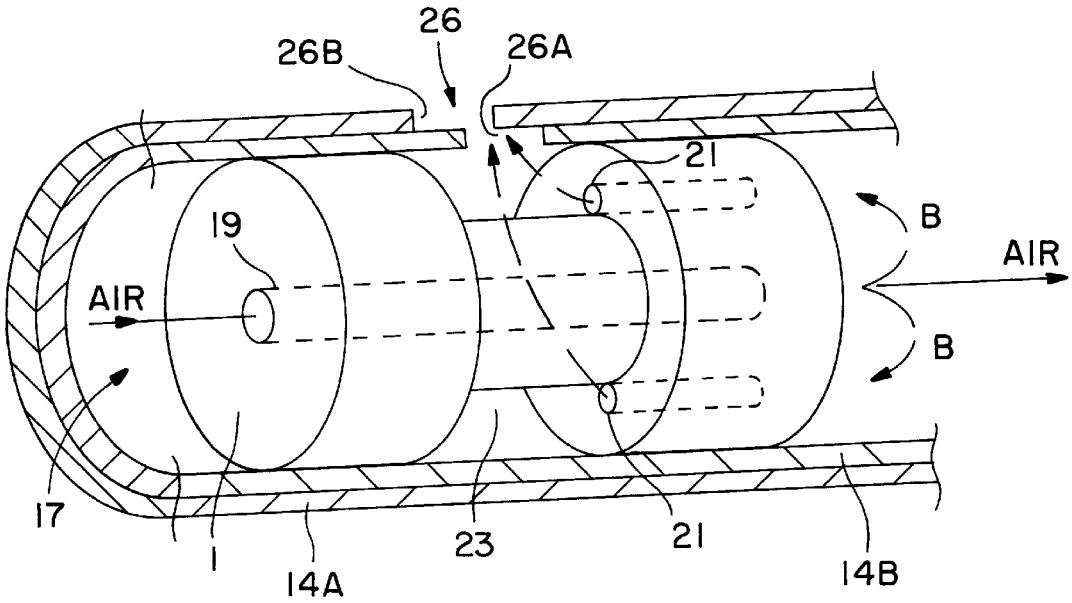
FIG. 2C shows details or the plug.

FIG. 2A is an exploded view of the anchor section 14 comprising an outer sleeve 14A slidably positioned on an inner sleeve 14B and a plug 17 that press fits into inner sleeve 14B. FIG. 2C shows details of the plug 17 to better advantage. As shown together with the sectional view FIG. 2B taken along line of sight 2A, plug 17 has central bore 19 permitting air to pass from the entry end of central bore 19 and out of the other end of the plug. Planet bores 21 (four are shown in FIG. 2B) lead from the exit end of the plug to a cavity 23 formed by a narrowed section of plug 17. Lug 17 is pressed into inner sleeve 14B to where air stream B which has split off the main stream A and flows back through the satelite bores 21, into cavity 23, and out through the CONTROLLABLE passageway 28, flowing through planet bores 21 into cavity 23 can escape through the passageway formed by apertures 26B in inner sleeve 14B and aperture 26A in outer sleeve 14A when apertures 26A and 26B are aligned.

The size of the passageway is adjustable by positioning the outer sleeve 14A relative to the inner sleeve 14B. The passage size is adjusted by either rotational or axial positioning of the outer sleeve 14A on the inner sleeve 14B.

In one embodiment, an entry end of the inner sleeve is secured (screwed into) the exit end of the housing 11. The exit end of the outer tube is secured to (an integral part of or screwed into) the neighboring telescoping section. The inner diameter of the outer sleeve is selected so that the outer sleeve slides more easily on the inner sleeve than the telescoping sections of the nozzle sliding on one another. In use, the apertures in the inner and outer sleeves are positioned so that the passageway is closed providing that maximum air flow is obtained with the pressure below a critical pressure. If the end of the nozzle is inadvertently stopped up, the pressure will increase and the tightness of the outer sleeve on the inner sleeve is such that the sleeves will extend at a critical pressure to a position where the passageway opens up. The pressure is thereby reduced preventing the telescoping sections from extending.

A collar 29 is shown mounted on the outer sleeve 14A. The tightness of the collar 28 on the outer sleeve 14A is adjustable by virtue of the cut 30 in the collar 28 and the adjustable screw 32 in the collar 28 through the cut 30. The tightness of the collar 28 determines the critical pressure in the air nozzle above which, the anchor section will extend so that the passageway increases from a completely closed position to a completely open position where air in side the nozzle 10 can escape.

Figure 3:
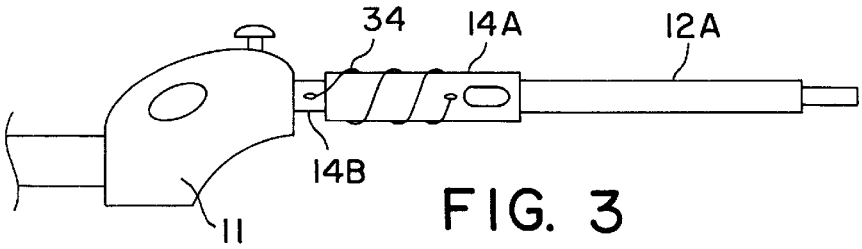
FIG. 3 shows the spring mounted on the anchor section.

FIG. 3 shows the gun 11 with a spring 34 mounted on the outer sleeve 14A and the outer sleeve 14A is spring biased both axially and rotationally to return to an orientation where the apertures 26 are aligned. When the mechanic is operating the gun 11, he holds the gun so that the passageway is completely closed providing maximum velocity of air through the nozzle of the gun. When he lets go of the nozzle, the passage formed by the apertures opens so that pressure in the nozzle will not increase to a dangerous level.

Figure 4:
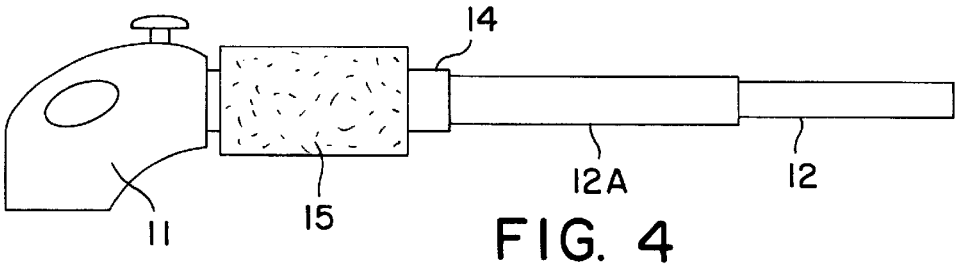
FIG. 4 shows the gun with the anchor section inside a porous tube.

FIG. 4 shows the gun with the anchor section 14 inside a porous tube 15. A fabric tube is preferred. The porous tube 15 encasing the anchor section 14 diffuses the air stream escaping through the passageway. This is a safety feature that prevents an air issuing through the passageway that could otherwise be a safety hazard or at least an annoyance. The porous tube has an alignment mark (not shown) which is aligned with an alignment mark on the outer sleeve to indicate alignment of the apertures.

There has been described an air gun having an extendable nozzle by virtue of telescoping tubular sections joined to one end of an anchor section whose other end is joined to an airgun. The anchor section has a passageway leading through the wall of the anchor section providing an air escape to prevent inadvertent extension of the nozzle when the exit of the nozzle is stopped up.

Variation and modifications of this invention may be contemplated after reading the specification and studying the drawings that are within the scope of the invention.

Figure 5:
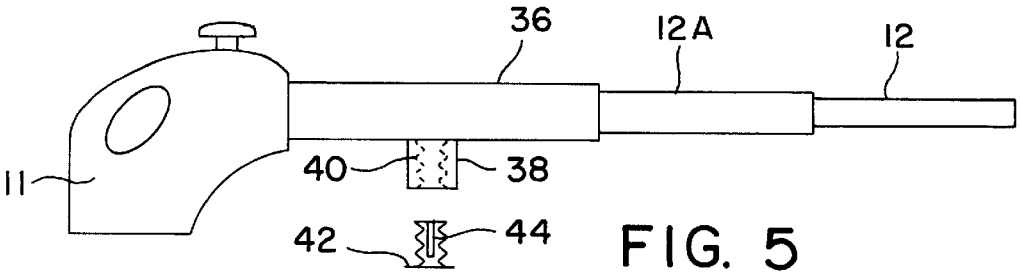
FIG. 5 shows another embodiment wherein the passageway is through a stud with a bore.

For example, FIG. 5 shows another construction of the anchor section being a tube 36 with a stud 38 having a threaded bore 40, secured in the side of anchor section and opening inside the anchor section. A screw 42 having a slot 44 screws into the threaded end of the stud 38. The size of the passageway is adjustable by positioning the screw.

In other embodiments:

- the anchor section is constructed such that the entrance end of the inner sleeve is secured to the exit end of the housing and the outer end of the inner sleeve is secured to the entrance end of the nozzle and the outer sleeve slides freely on the inner sleeve as discussed;
- the entrance end of the outer sleeve is secured to the exit end of the housing and the exit end of the inner sleeve is secured to the entrance end of the nozzle;
- the entrance end of the inner sleeve is secured to the exit end of the housing and the exit end of the outer sleeve is secured to the entrance end of the nozzle;
- one of the inner sleeve and the outer sleeve of the anchor being integrally is formed as one piece with the first section of the adjustable length nozzle:
- the anchor section of the nozzle and gun are integrally joined;

the nozzle or nozzle with valve is attachable to another source of compressed air or gas such as directly to a compressor tank or cylinder;

the compressed gas is any one of a number of gases including, oxygen, nitrogen, carbon dioxide, etc.

I therefore wish to define the scope of the invention by the appended claims.

I claim:

1. A nozzle being of the type attachable to a source of compressed gas and being the type having a plurality of extensible telescoping sections comprising:

a tubular anchor section having means for joining an entrance end of said anchor section to said source and means for joining an exit end of said anchor section to an entrance end of said plurality of extensible sections;

said tubular anchor section having a section wall with a passageway through said section wall from inside said anchor section to outside said anchor section;

said passageway having a sectional area and having a length being a thickness of said section wall;

means for adjusting a size of said sectional area of said passageway from being completely closed to a size where gas pressure is prevented from building in said nozzle causing inadvertent extension of said nozzle.

2. The nozzle of claim 1 wherein said means for adjusting said area comprises:

a stud having a threaded bore and an end of said stud secured in the side of said tubular anchor section providing that air is enabled to pass between inside said anchor section to outside said anchor section;

a screw having an axial slot operably arranged to provide that said screw screwed into a threaded end of the stud permits adjustment of size of said passageway.

3. The nozzle of claim 1 wherein said tubular anchor section comprises:

an inner sleeve and an outer sleeve, said outer sleeve slidably telescoping onto said inner sleeve;

said inner sleeve having an aperture and said outer sleeve having an aperture providing that said passageway is open when said aperture in said inner sleeve and said aperture n said outer sleeve are aligned and said passageway is completely closed when said apertures are misaligned.

4. The nozzle of claim 3 comprising:

a plug secured in said inner sleeve;

a bore extending from an entrance end of said plug to an exit end of said plug whereby said gas is enabled to pass through said plug;

said plug constructed in operable combination with said inner sleeve to form a cavity between an inner surface of said inner sleeve and an outer surface of said plug;

at least one planet bore leading from said exit end of said plug to said cavity;

said cavity secured in said inner sleeve at a location whereby gas is enabled to pass from said exit end of said anchor section, through said at least one bore through said cavity and out through said passageway when said passageway is open.

5. The nozzle of claim 4 further comprising:

a spring mounted on said outer sleeve;

said spring having one end secured to said outer sleeve and an other end secured to said inner sleeve;

said spring biased both axially and rotationally to return to a position where the aperture in the inner sleeve is aligned with said aperture in said aperture in said inner sleeve providing that, when a mechanic holds said nozzle with said passageway completely closed, maximum velocity of gas through said nozzle is achieved and when he releases said nozzle, said passageway opens whereby pressure in the nozzle is prevented from increasing to a level causing said telescoping nozzle to extend.

6. The nozzle of claim 4 further comprising:

a collar dimensioned to slide onto and around said outer sleeve;

said collar having a slot and tightening screw operably arranged to select tightness of said collar on said outer sleeve.

7. The nozzle of claim 4 further comprising a porous tube mounted on and enclosing said outer sleeve providing that any gas stream issuing through said passageway is diffused.

8. The nozzle of claim 7 wherein said porous tube is made of fabric.

9. The nozzle of claim 8 wherein said tube has an alignment mark and said anchor section has an alignment mark operably arranged to indicate alignment of said apertures when said alignment marks are aligned.

10. The nozzle of claim 1 wherein the source has an exit that is a threaded opening and said means for joining an entrance end of said anchor section to said source comprises a thread on said anchor end.

11. The nozzle of claim 1 further comprising a gun having a housing with an entrance and an exit and a valve operably constructed to control passage of gas through said housing and said means for joining an entrance end of said anchor section to said source comprises a thread on said anchor end engaging a threaded opening on said exit.

12. The nozzle of claim 1 further comprising a gun having a housing with an entrance and an exit and a valve operably constructed to control passage of gas through said housing and said means for joining an entrance end of said anchor section to said source comprises said anchor section being integrally joined to said gun and communicating with said gun through said exit of said housing and entrance of said anchor section.

13. A nozzle being of the type attachable to a source of compressed gas and being the type having a plurality of extensible telescoping sections comprising:

an inner sleeve and an outer sleeve, said outer sleeve slidably telescoping onto said inner sleeve;

said inner sleeve having an entrance end joined joinable to said source;

said outer sleeve having an exit end joined to an entrance end of said plurality of telescoping sections;

said inner sleeve having an aperture and said outer sleeve having an aperture providing that a passageway is open when said aperture in said inner sleeve and said aperture in said outer sleeve are aligned and said passageway is completely closed when said apertures are misaligned;

a plug secured in said inner sleeve;

a bore extending from an entrance end of said plug to an exit end of said plug whereby said gas is enabled to pass through said plug;

said plug constructed in operable combination with said inner sleeve to form a cavity between an inner surface of said inner sleeve and an outer surface of said plug;

at least one planet bore leading from said exit end of said plug to said cavity;

said cavity secured in said inner sleeve at a location whereby gas is enabled to pass from said exit end of said anchor section, through said at least one bore through said cavity and out through said passageway when said passageway is open a spring mounted on said outer sleeve;

said spring having one end secured to said outer sleeve and an other end secured to said inner sleeve;

said spring biased both axially and rotationally to return to a position where the aperture in the inner sleeve is aligned with said aperture in said aperture in said inner sleeve providing that, when a mechanic holds said nozzle with said passageway completely closed, maximum velocity of gas through said nozzle is achieved and when he releases said nozzle, said passageway opens whereby pressure in the nozzle is prevented from increasing to a level causing said telescoping nozzle to extend;

a collar dimensioned to slide onto and around said outer sleeve;

said collar having a slot and tightening screw operably arranged to select tightness of said collar on said outer sleeve.

* * * * *